US009354006B2

(12) United States Patent
Purkiss

(10) Patent No.: US 9,354,006 B2
(45) Date of Patent: May 31, 2016

(54) DUAL MAGAZINE ASSEMBLY

(71) Applicant: Joshua Purkiss, Chicago, IL (US)

(72) Inventor: Joshua Purkiss, Chicago, IL (US)

( * ) Notice: Subject to any disclaimer, the term of this patent is extended or adjusted under 35 U.S.C. 154(b) by 0 days.

(21) Appl. No.: 14/030,969

(22) Filed: Sep. 18, 2013

(65) Prior Publication Data

US 2016/0003567 A1 Jan. 7, 2016

(51) Int. Cl.
*F41A 9/61* (2006.01)
*F41A 9/68* (2006.01)

(52) U.S. Cl.
CPC ..... *F41A 9/68* (2013.01)

(58) Field of Classification Search
CPC ..... F41A 9/68
USPC ..... 42/50, 49.01
See application file for complete search history.

(56) References Cited

U.S. PATENT DOCUMENTS 3,191,332 A * 6/1965 Ardolino ..... F41A 9/63 42/50
4,447,976 A 5/1984 Cooper
4,484,403 A * 11/1984 Schwaller ..... B65D 21/0204 42/50
4,685,238 A * 8/1987 Schoepflin ..... F16B 5/0004 42/90
5,279,059 A 1/1994 Howard
7,497,043 B2 3/2009 Clifton

* cited by examiner

*Primary Examiner* — Reginald Tillman, Jr.

(57) ABSTRACT

An dual magazine assembly that has many novel features desirable by modern military and law enforcement professionals that consists of two magazine adaptors that replace the standard bottom magazine plates of a firearm. These adaptors once mated with identical magazine housings can then be quickly attached to each other in order to shorten the magazine reloading time by rotating the spent primary magazine towards the bottom and inserting the secondary magazine thus doubling the capacity and allowing for faster firing of rounds from the secondary magazine.

4 Claims, 7 Drawing Sheets

DUAL MAGAZINE ASSEMBLY

FIELD OF THE INVENTION

The present invention relates to the field of dual magazine assembly, and more particularly to a dual magazine assembly that has unique capabilities for use in shortening magazine reloading times.

BACKGROUND OF THE INVENTION

Dual magazine assembly are well known in the art and continue to grow in popularity due to their many desirable features. In particular, dual magazine assembly that can provide direct benefits to the military and police communities when the use of deadly force has been authorized is the focus of the present invention.

There are several flaws with existing prior art devices. The first and perhaps most important flaw is that present dual magazine assembly typically make firing the modified weapon more difficult due to the added weight and change in the center of gravity caused by the addition of extra parts to attach the magazines together. Because of this, many police and military firearm users do not use dual magazine assembly as it is felt that weapon accuracy will be adversely impacted.

Another common drawback to prior art devices is that they are not designed for rapid assembly. Although this flaw would be of minimal importance to the average sportsman firearm user, the extra time to assemble or disassemble a dual magazine assembly is of the utmost importance to a military or law enforcement professional.

A third and final major drawback with prior art devices is poor durability in the field. Many dual magazine assembly are made of cheap thermoplastic materials which easily break or crack under the heat and stress of operation. Clearly there is a need for an improved dual magazine assembly that resolve these known problems.

BRIEF SUMMARY OF THE INVENTION

It is an object of the present invention to provide a dual magazine assembly that can shorten magazine reloading time.

It is yet another object of the present invention to provide a dual magazine assembly that that is easy to assemble and disassemble with a shorter time versus prior art devices.

It is a final object of the present invention to provide a dual magazine assembly that is designed to be more durable for use in the field.

DETAILED DESCRIPTION OF THE INVENTION

Referring now to the drawings and in particular FIG. 1, the dual magazine assembly according to the present invention is generally designated by reference numeral 1000. 1000 is further comprised of a primary magazine housing 100, a secondary magazine housing 200, a primary magazine adaptor 300, and a secondary magazine adaptor 400. Each of these components shall be further described in sufficient detail in order to explain the novel aspects of the present invention.

Referring next to FIG. 2, the primary magazine portion of dual magazine assembly 1000 is shown in a detailed view. It first should be noted that although said primary magazine housing 100 shown is that of a Glock 9 mm magazine, the concept of the present invention extends to other firearm calibers that use similar magazine housings with removable bottom plates. In the preferred embodiment shown, said primary magazine 100 has mating features 110 and 120. Said mating feature 110 represents a flange which is generally rectangular and has a thickness sufficient to engage into corresponding recessed slot 310 of said primary magazine adaptor 300. Said primary magazine 100 is locked into said primary magazine adaptor 300 via a plurality of opposing locking tab 120 and corresponding locking slot 320 located on said primary magazine adaptor 300. Said primary magazine adaptor 300 further contains at least one access hole 330 for use with known prior art tools used for removing the typical prior art bottom magazine plate. Thus, said primary magazine adaptor 300 in the preferred embodiment is a direct replacement for the prior art bottom plate of a prior art solitary magazine.

Referring next to FIG. 3, the secondary magazine portion of dual magazine assembly 1000 is shown in a detailed view. In the preferred embodiment shown, said secondary magazine 200 has mating features 210 and 220. Said mating feature 210 represents a flange which is generally rectangular and has a thickness sufficient to engage into corresponding recessed slot 410 of said secondary magazine adaptor 400. Said secondary magazine 200 is locked into said secondary magazine adaptor 400 via a plurality of opposing locking tabs 220 and corresponding locking slots 420 located on said secondary magazine adaptor 400. Said secondary magazine adaptor 400 further contains at least one access hole 430 for use with known prior art tools used for removing the typical prior art bottom magazine plate. Thus, said secondary magazine adaptor 400 in the preferred embodiment is a direct replacement for the prior art bottom plate of a prior art solitary magazine.

Referring next to FIGS. 4 and 5, the primary magazine adaptor 300 and secondary magazine adaptor 400 are shown in detailed isometric views in order to show the specific preferred embodiment. Said protrusion block 335 located on one side of said primary adaptor 300 further consists of a plurality of perpendicular oriented T shaped protrusions 340 which have an acute angle shape in order to engage with corresponding T shaped pockets 460 located on secondary magazine adaptor 400. Said primary adaptor 300 further contains at least one recessed pocket 350 which is engaged for mating with said T shaped protrusions 450 located on secondary adaptor 400. Said primary and secondary adaptors 300 and 400 are slidably engaged into each other and locked in place using said locking hinged tab 440 located on secondary adaptor 400 and corresponding locking post 360 located on primary adaptor 300. Said primary and secondary adaptors 300 and 400 further contain said end protrusions 370 and 470 which prevent longitudinal slippage of said dual magazine assembly 1000 when in use in a firearm.

Referring finally to FIGS. 6 and 7, the preferred assembly method for rigid connection of said primary magazine 100 to said secondary magazine 200 is shown in isometric view. Although two T shaped protrusions 340 and 450 are shown in the preferred embodiment, it should be noted that additional protrusions may also accomplish the same level of engagement between said primary adaptor 300 and secondary adaptor 400. During connection of said adaptors, the angled shape of said primary T shaped protrusion 340 assists in smoothly fitting into recessed T shaped pockets 460 (previously shown in FIG. 5.) Said locking hinge tab 440 is designed to have flexibility such that during engagement said post 360 pushes down said hinged tab 440 until said post 360 locks into circular hole feature of said locking hinge tab 440. The final assembly and mating of dual magazine assembly 1000 with reference firearm 900 is shown in FIG. 7.

Figure 1:
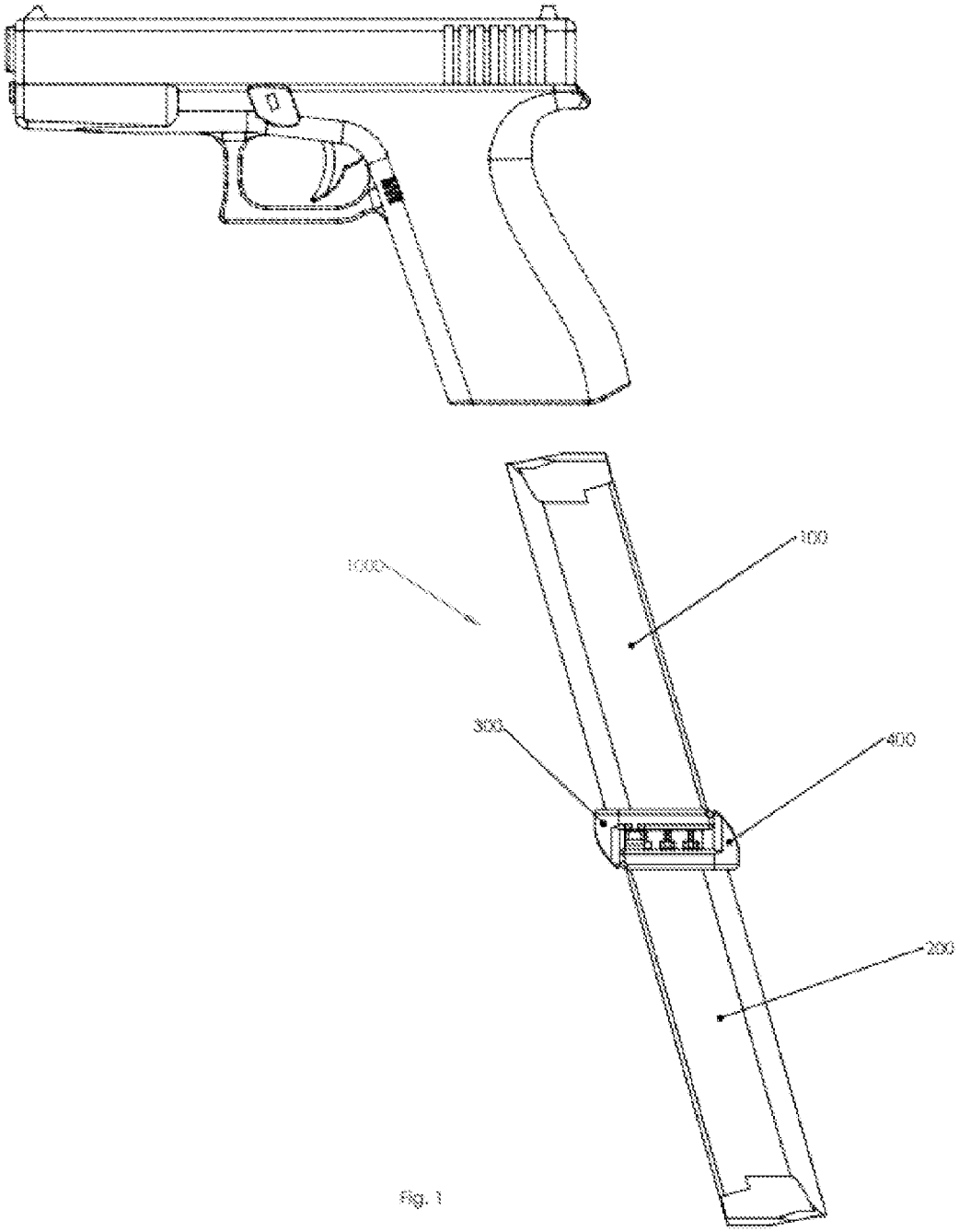
FIG. 1 is a side view showing the dual magazine assembly in the correct orientation prior to final insetion into a pistol.
Figure 2:
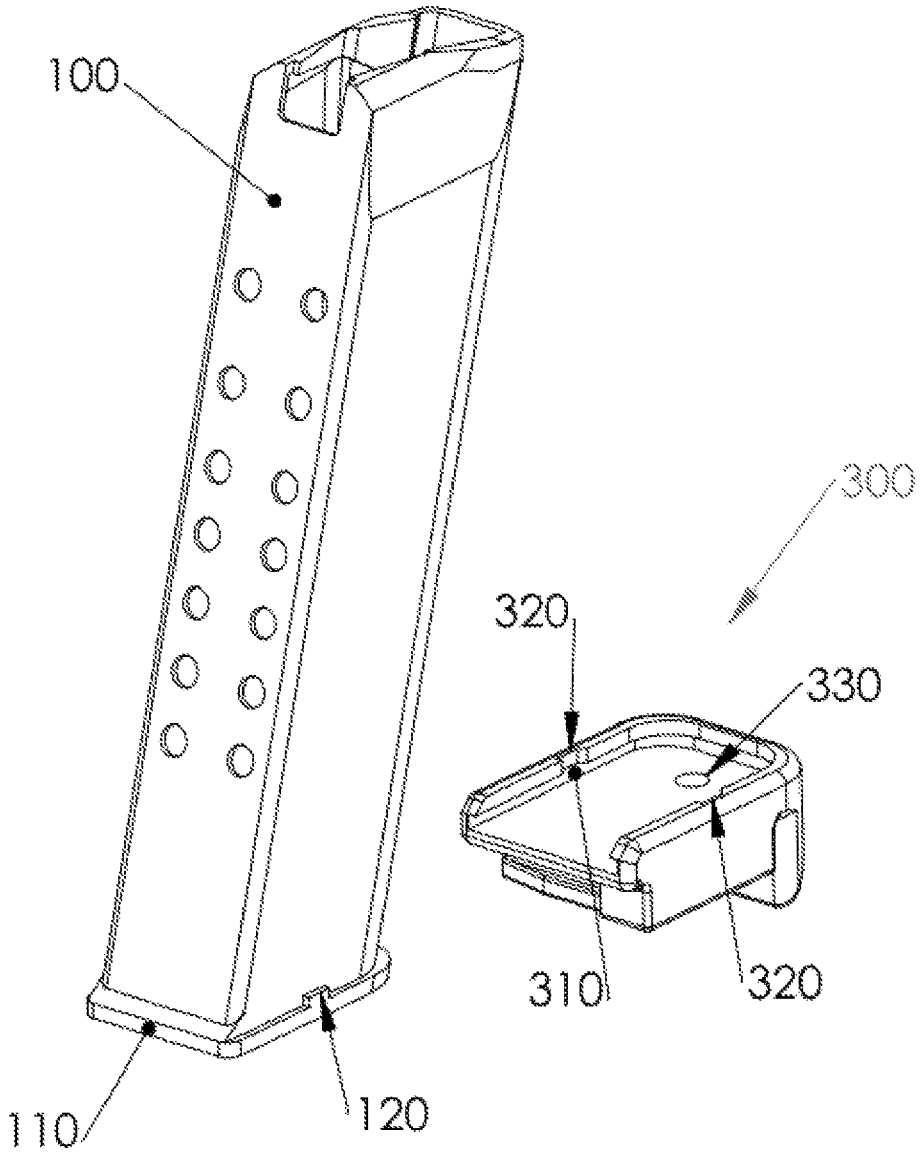
FIG. 2 is an isometric view of the primary magazine adaptor in the correct orientation prior to final assembly.
Figure 3:
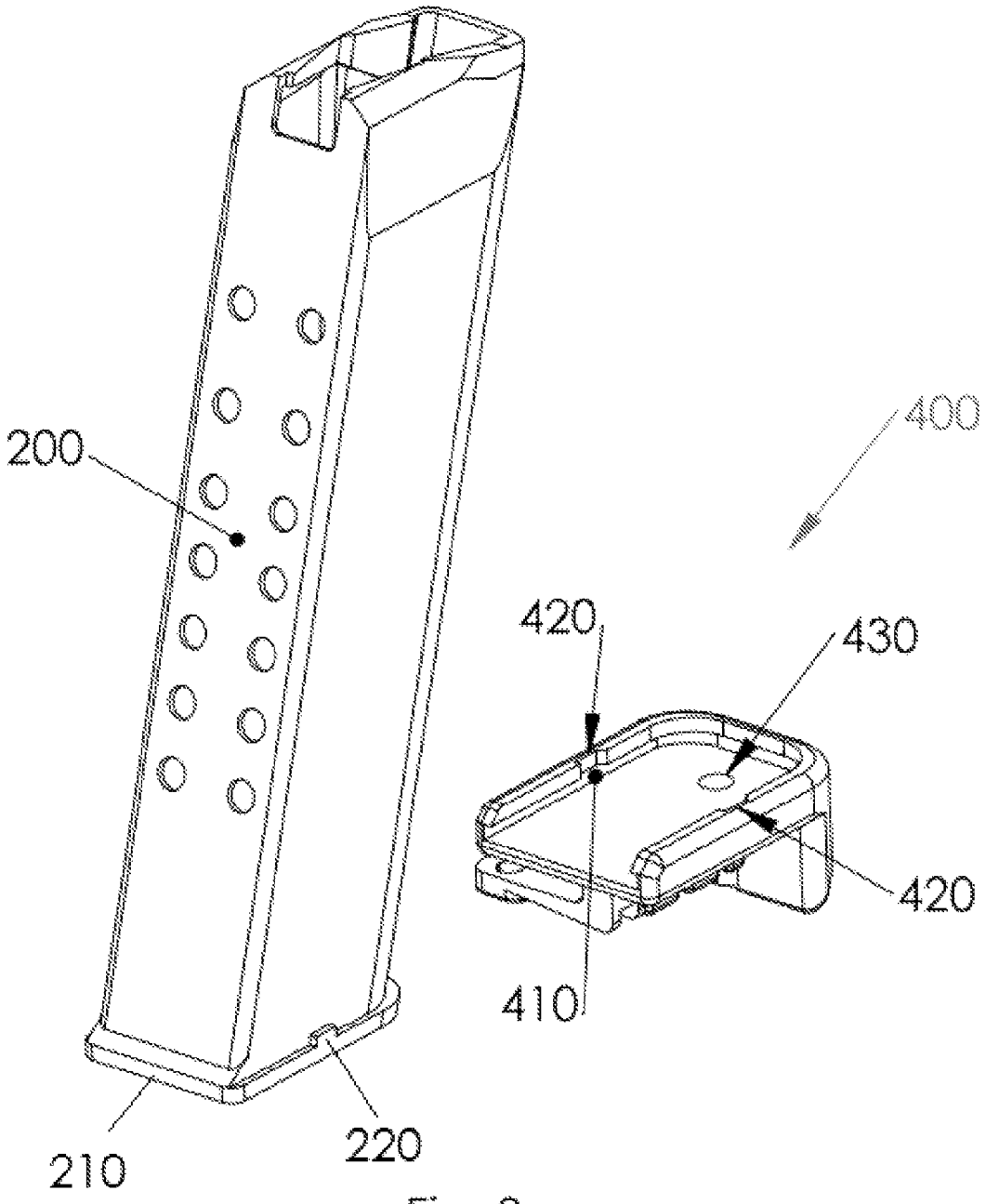
FIG. 3 is an isometric view of the secondary magazine adaptor in the correct orientation prior to final assembly.
Figure 4:
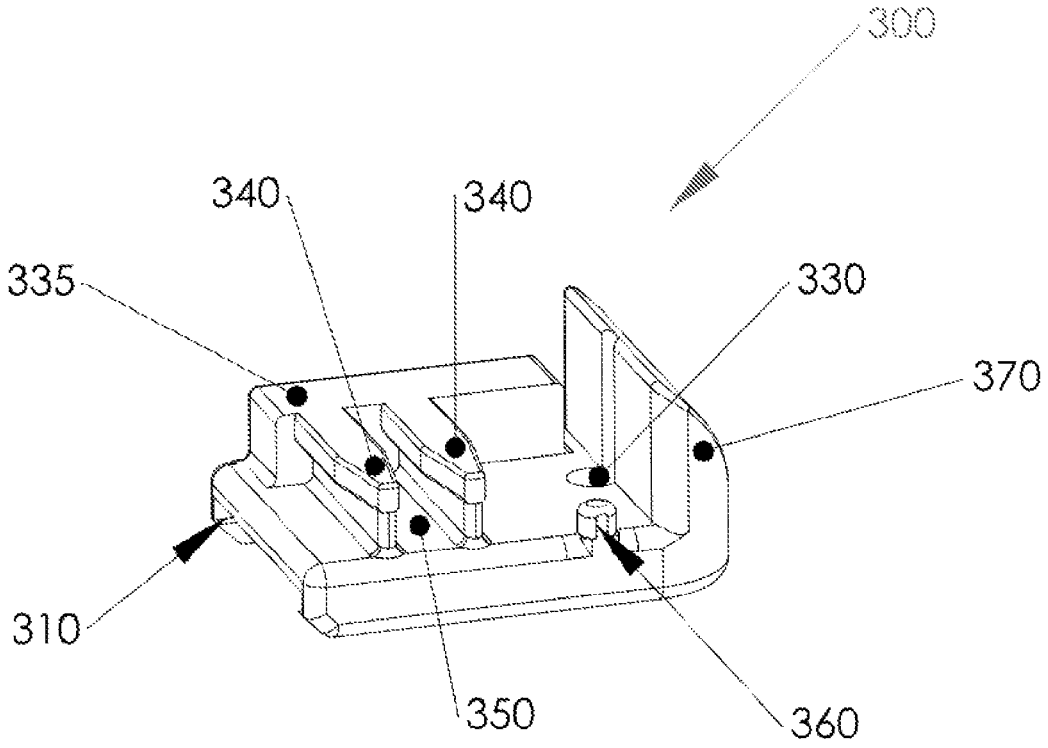
FIG. 4 is an isometric view of the primary magazine adaptor.
Figure 5:
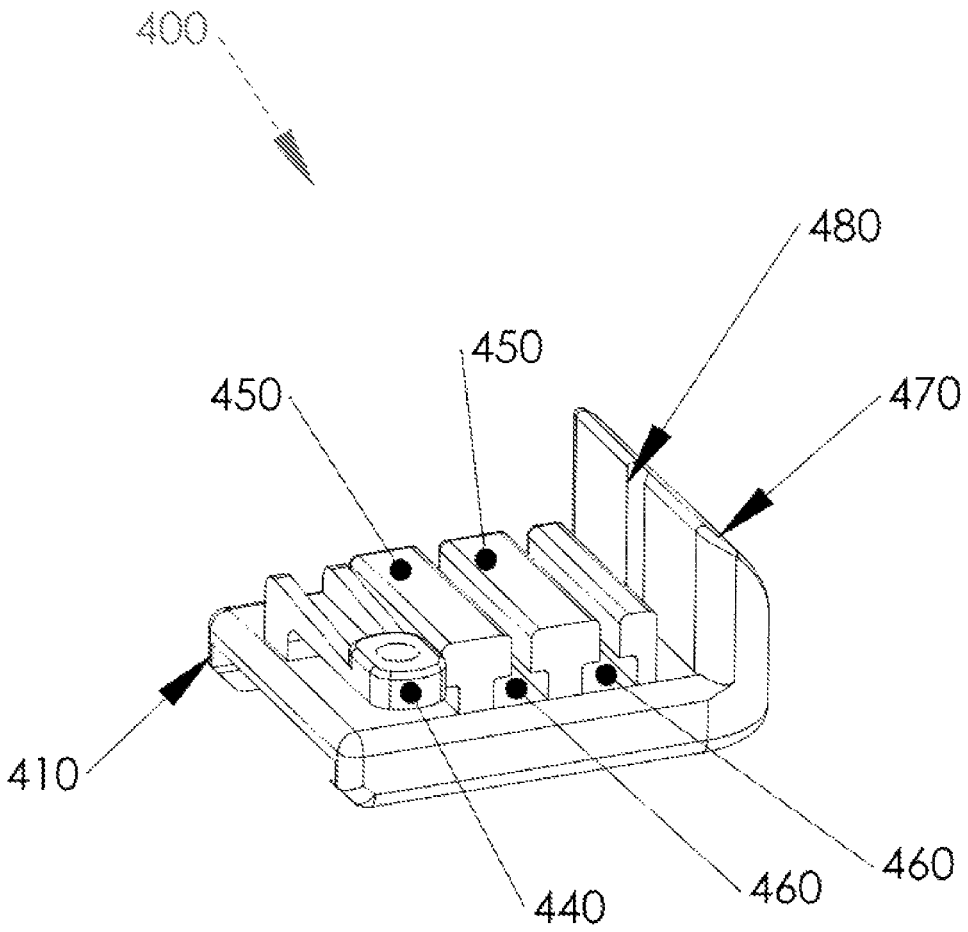
FIG. 5 is an isometric view of the secondary magazine adaptor.
Figure 6:
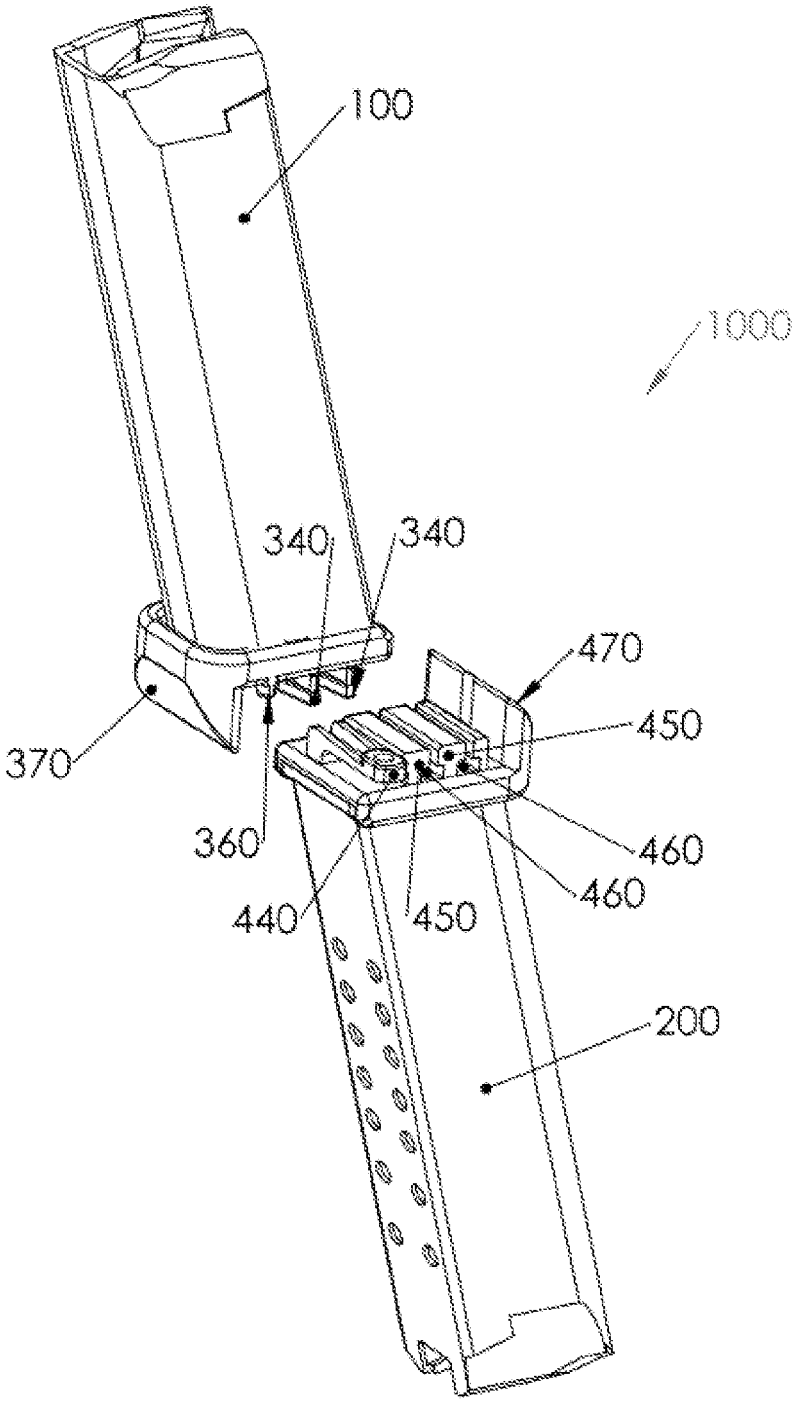
FIG. 6 is an isometric view of the primary and secondary magazines in the correct orientation prior to final assembly.
Figure 7:
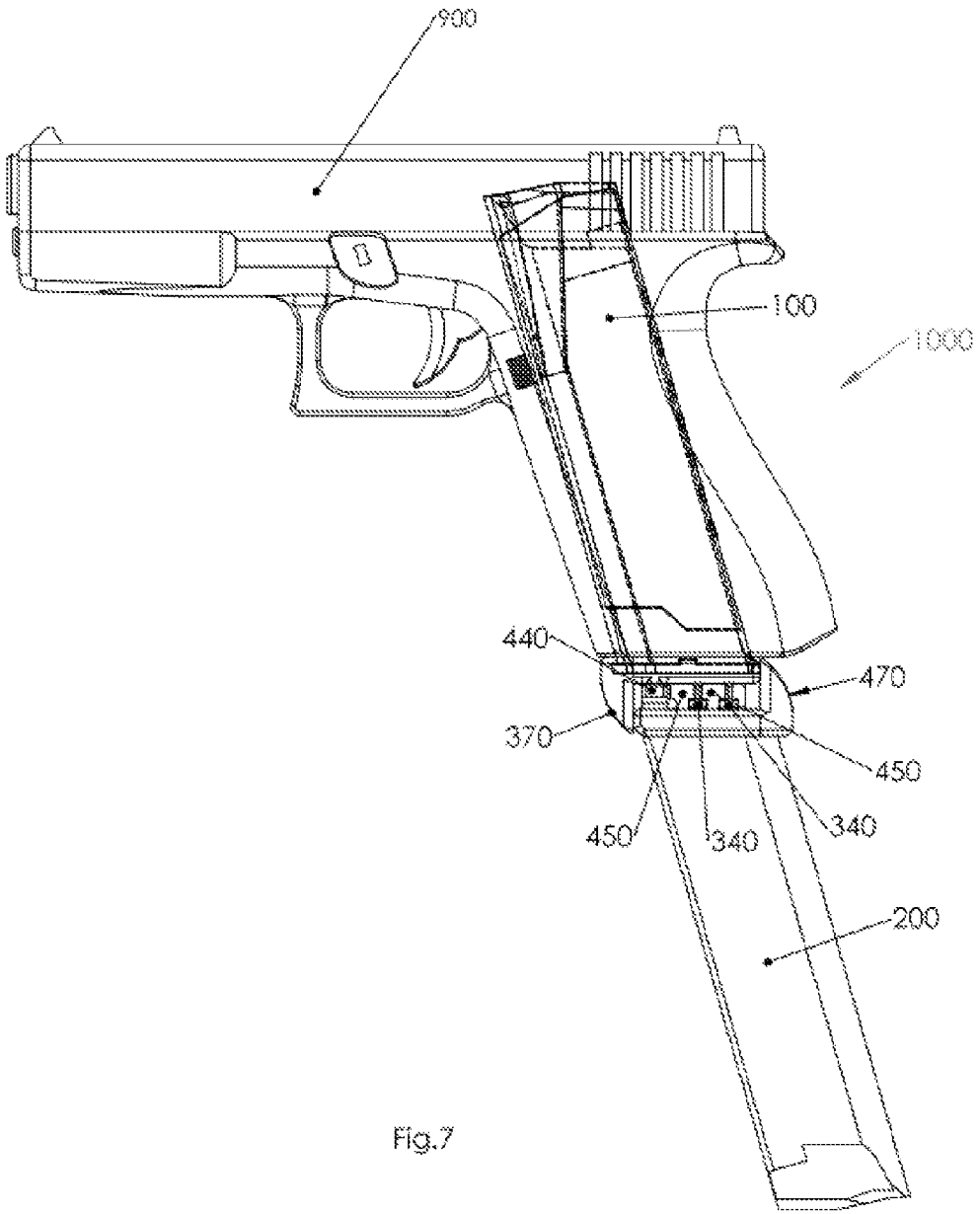
FIG. 7 is a side view showing the dual magazine assembly fully inserted into a pistol.

What is claimed is:

1. A firearm magazine system comprising:

a primary magazine housing having a top end for receiving cartridges and a bottom end;

a secondary magazine housing having a top end for receiving cartridges and a bottom end;

a primary magazine adapter plate; and a secondary magazine adapter plate, wherein the primary magazine adapter plate has a top surface including a slot that matches and receives the bottom end profile of the primary magazine housing, the bottom surface of the primary magazine adapter plate has a plurality of parallel T-shaped protrusions, and a locking post.

2. The firearm magazine system of claim 1, wherein the top surface of the secondary magazine adapter plate comprises at least one L-shaped protrusion, a plurality of T-shaped protrusions, and a hinged tab that terminates at its distal end with a rectangular window, wherein the L-shaped protrusion, the T-shaped protrusions and the post of secondary magazine adapter plate are configured for matingly engaging the bottom surface of the primary magazine adapter plate, whereby the bottom ends of both magazines a selectively attachable.

3. The firearm magazine system of claim 1, wherein the adapter plates are made of thermoplastic.

4. The firearm magazine system of claim 1, wherein the adapter plates are made of metal.

* * * * *